US008923738B2

(12) United States Patent
Nagata

(10) Patent No.: US 8,923,738 B2
(45) Date of Patent: Dec. 30, 2014

(54) IMAGE HEATING APPARATUS, FIXING APPARATUS AND IMAGE FORMING APPARATUS

(71) Applicant: Canon Kabushiki Kaisha, Tokyo (JP)

(72) Inventor: Teppei Nagata, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/870,394

(22) Filed: Apr. 25, 2013

(65) Prior Publication Data

US 2013/0287458 A1 Oct. 31, 2013

(30) Foreign Application Priority Data

Apr. 27, 2012 (JP) ..... 2012-103009

(51) Int. Cl.
*G03G 21/16* (2006.01)
*G03G 15/20* (2006.01)

(52) U.S. Cl.
CPC ..... *G03G 21/1695* (2013.01); *G03G 15/2035* (2013.01); *G03G 2215/2022* (2013.01)
USPC ..... 399/323; 399/320

(58) Field of Classification Search
USPC ..... 399/323
See application file for complete search history.

(56) References Cited

U.S. PATENT DOCUMENTS

| | | | |
|---|---|---|---|
| 8,107,864 | B2 | 1/2012 | Saito et al. |
| 2009/0110449 | A1 | 4/2009 | Saito et al. |
| 2013/0108335 | A1 | 5/2013 | Nagata |

FOREIGN PATENT DOCUMENTS

| | | | |
|---|---|---|---|
| JP | 2-208679 | A | 8/1990 |
| JP | 2009-122632 | A | 6/2009 |

*Primary Examiner* — Clayton E Laballe
*Assistant Examiner* — Jas Sanghera
(74) *Attorney, Agent, or Firm* — Fitzpatrick, Cella, Harper & Scinto

(57) ABSTRACT

An image heating apparatus includes: a rotatable member; a pair of frames; a separating unit including a separating plate and a pair of spacers; and a holding unit including a holding portion and an urging portion. The holding unit is rotatable between a first position where the spacers are abutted against the rotatable member and a second position where the spacers are spaced from the rotatable member. The frames include a pair of shaft portions, and the separating unit includes a pair of guiding slots with movement of the holding unit from the second position to the first position. The holding portion permits inclination of the separating unit so that only one of the shaft portions is abutted against a stopper portion of its associated guiding slot with the abutment of the spacers against the rotatable member.

19 Claims, 7 Drawing Sheets

(a)

(b)

(a)

(b)

(c)

(a)

(b)

(a)

(b)

IMAGE HEATING APPARATUS, FIXING APPARATUS AND IMAGE FORMING APPARATUS

FIELD OF THE INVENTION AND RELATED ART

The present invention relates to an image heating apparatus for heating a toner image on a sheet, a fixing apparatus for fixing the toner image on the sheet, and an image forming apparatus.

Heretofore, in an image forming apparatus, the toner image is formed on a recording material (sheet) at an image forming portion, and thereafter is fixed on the recording material by applying heat and pressure to the toner image by the fixing apparatus (image heating apparatus). When such a fixing process is performed, it has been required that the recording material is stably separated from a rotatable fixing member (rotatable pressing member).

Therefore, in fixing apparatuses described in Japanese Laid-Open Patent Application (JP-A) Hei 2-208679 and JP-A 2009-122632, a separating plate is provided near to the rotatable fixing member. Specifically, a constitution in which the separating plate is brought near to the rotatable fixing member via a spacer is employed.

On the other hand, when the fixing process is performed, there is a possibility that a recording material having small rigidity is jammed in the fixing apparatus. In such a case, a constitution in which the separating plate is largely retracted to expose an exit portion of a fixing nip so that the jammed recording material can be easily removed by an operator (user) has been required.

However, in the fixing apparatuses described in JP-A Hei 2-208769 and JP-A 2009-122632, the constitution in which the separating plate is largely retracted is not employed, and therefore there is room for improvement in terms of the ease with which an operator can perform jam clearance.

SUMMARY OF THE INVENTION

A principal object of the present invention is to provide an image heating apparatus capable of not only facilitating jam clearance, but also properly ensuring a space between a separating plate and a rotatable heating member.

Another object of the present invention is to provide a fixing apparatus capable of not only facilitating the jam clearance, but also properly ensuring a space between the separating plate and a rotatable fixing member.

A further object of the present invention is to provide an image forming apparatus capable of not only facilitating the jam clearance, but also properly ensuring a space between the separating plate and a rotatable conveying member.

According to an aspect of the present invention, there is provided an image heating apparatus comprising: a rotatable member for forming a nip for heating a toner image on a sheet; a pair of frames for rotatably supporting the rotatable member at widthwise ends of the rotatable member; a separating unit including a separating plate for separating the sheet from the rotatable member and a pair of spacers for forming a space between the separating plate and the rotatable member by being abutted against the rotatable member at the widthwise ends, respectively; and a holding unit including a holding portion for rotatably holding the separating unit and an urging portion for urging the separating unit toward the rotatable member. The holding unit is rotatable about a rotation center between a first position where the pair of spacers is abutted against the rotatable member and a second position where the pair of spacers is spaced from the rotatable member. The pair of frames includes a pair of shaft portions, and the separating unit includes a pair of guiding slots for guiding the pair of shaft portions, respectively, with movement of the holding unit from the second position to the first position. The holding portion permits inclination of the separating unit so that only one of the pair of shaft portions is abutted against a stopper portion of its associated guiding slot with the abutment of the pair of spacers against the rotatable member.

According to another aspect of the present invention, there is provided a fixing apparatus comprising: a rotatable fixing member for fixing a toner image on a sheet at a nip; a pair of frames for rotatably supporting the rotatable fixing member at widthwise ends of the rotatable fixing member; a separating unit including a separating plate for separating the sheet from the rotatable fixing member and a pair of spacers for forming a space between the separating plate and the rotatable fixing member by being abutted against the rotatable fixing member at the widthwise ends, respectively; and a holding unit including a holding portion for rotatably holding the separating unit and an urging portion for urging the separating unit toward the rotatable fixing member. The holding unit is rotatable about a rotation center between a first position where the pair of spacers is abutted against the rotatable fixing member and a second position where the pair of spacers is spaced from the rotatable fixing member. The pair of frames includes a pair of shaft portions provided in widthwise end sides of the rotatable fixing member, and the separating unit includes a pair of guiding slots for guiding the pair of shaft portions, respectively, with movement of the holding unit from the second position to the first position. The holding portion permits inclination of the separating unit so that only one of the pair of shaft portions is abutted against a stopper portion of its associated guiding slot with the abutment of the pair of spacers against the rotatable fixing member.

According to a further aspect of the present invention, there is provided an image forming apparatus comprising: a rotatable conveying member conveying a sheet at a nip; a pair of frames for supporting the rotatable conveying member; a separating unit including a separating plate for separating the sheet from the rotatable conveying member and a pair of spacers for forming a space between the separating plate and the rotatable conveying member by being abutted against the rotatable conveying member at the widthwise ends, respectively; and a holding unit including a holding portion for rotatably holding the separating unit and an urging portion for urging the separating unit toward the rotatable conveying member. The holding unit is rotatable about a rotation center between a first position where the pair of spacers is abutted against the rotatable conveying member and a second position where the pair of spacers is spaced from the rotatable conveying member. The pair of frames includes a pair of shaft portions provided in widthwise end sides of the rotatable conveying member, and the separating unit includes a pair of guiding slots for guiding the pair of shaft portions, respectively, with movement of the holding unit from the second position to the first position. The holding portion permits inclination of the separating unit so that only one of the pair of shaft portions is abutted against a stopper portion of its associated guiding slot with the abutment of the pair of spacers against the rotatable conveying member.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of the present invention will be described specifically with reference to the drawings. Incidentally, within the scope of the present invention, part of all of constituent elements in the following embodiments can be replaced with other known constituent elements. As an image heating apparatus, not only a fixing apparatus described later, but also a glossing (gloss-processing) apparatus for adjusting (improving) glossiness of an image are applicable.

An image forming apparatus described below is not limited to a printer described below, but can be used in various uses as a copying machine, a facsimile machine, a multi-function machine having a printer function, a copying function and a facsimile function, and the like machine.

Figure 1:
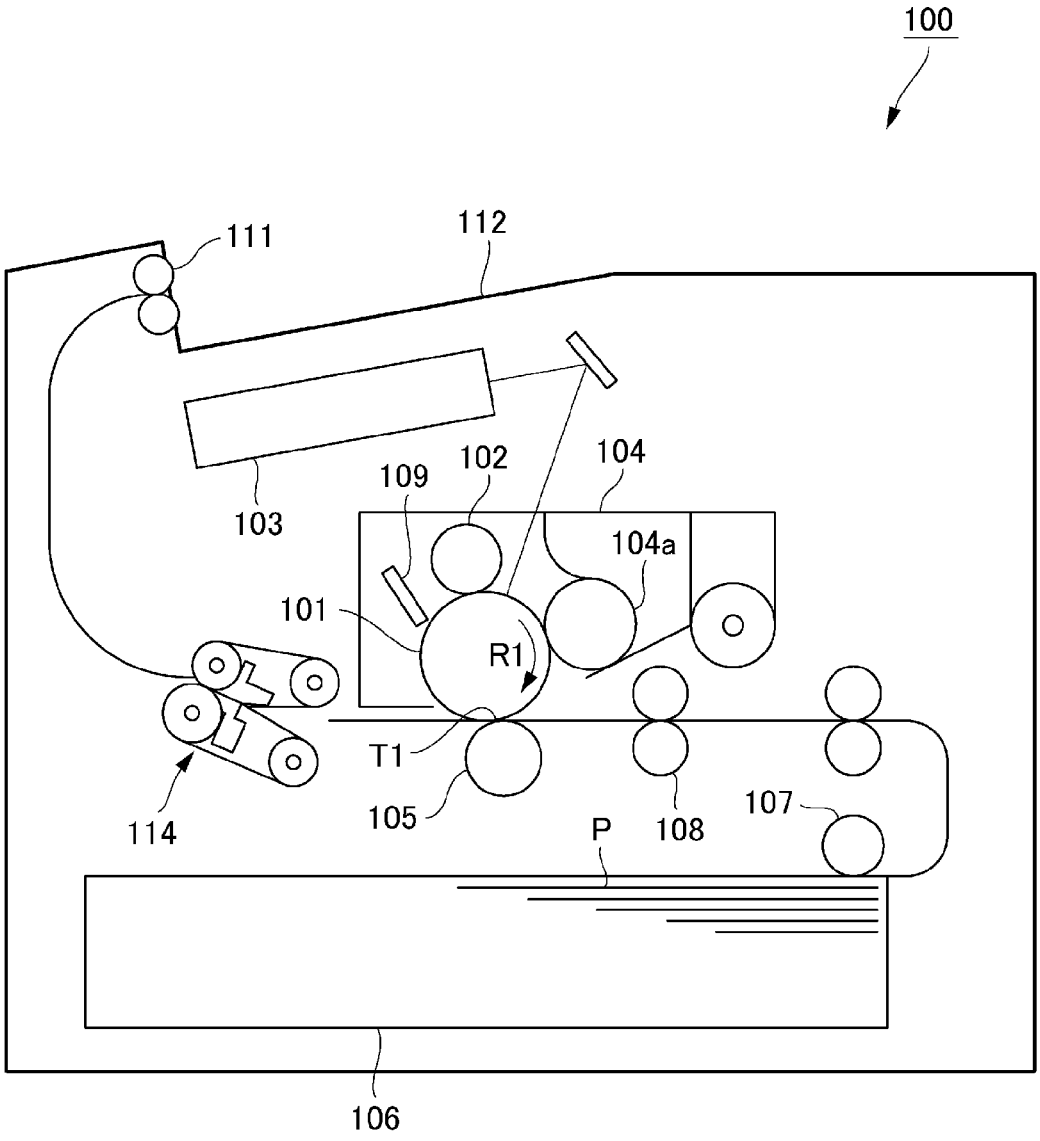
FIG. 1 is an illustration of a structure of an image forming apparatus.

FIG. 1 is an illustration of a structure of an image forming apparatus 100. As shown in FIG. 1, the image forming apparatus 100 is a laser beam printer in which a toner image formed on a photosensitive drum 101 is transferred onto a recording material and then is fixed as an image on the recording material by a fixing apparatus (device) 114. The image forming apparatus 100 includes the photosensitive drum 101 and includes, at a periphery of the photosensitive drum 101, a charging roller 102, an exposure device 103, a developing device 104, a transfer roller 105 and a drum cleaning device 109. The photosensitive drum 101 is an electrophotographic photosensitive member prepared by forming a photosensitive material, such as an OPC or amorphous silicon, on a cylinder-like substrate of aluminum or the like.

The charging roller 102 electrically charges the photosensitive drum 101 to a uniform potential. The exposure device 103 forms an electrostatic image for an image on the surface of the photosensitive drum 101 by scanning the photosensitive drum surface with a laser beam subjected to ON-OFF modulation depending on an image signal developed from image data. The developing device 104 carries a one-component developer on a developing sleeve 104*a* and develops the electrostatic image on the photosensitive drum 101 into a toner image. The transfer roller 105 is press-contacted to the photosensitive drum 101 to form a nip T1 for a recording material (sheet) P. By applying a voltage to the transfer roller 105, the toner image carried on the photosensitive drum 101 is transferred onto the recording material P conveyed through the nip T1.

The recording material P taken out from a cassette 106 by a sheet feeding roller 107 is fed to the nip T1 by a registration roller 108 in synchronism with the toner image on the photosensitive drum 101. The recording material P on which the toner image is transferred at the nip T1 and which is then separated from the photosensitive drum 101 is conveyed to the fixing apparatus 114. The fixing apparatus 114 heats and presses the recording material P on which an unfixed toner image is carried, thus fixing the image on the recording material P. The recording material P on which the image is fixed is discharged and stacked on a sheet discharge tray 112 on a casing by a sheet discharging roller 111.

<Fixing Apparatus>

Figure 2:
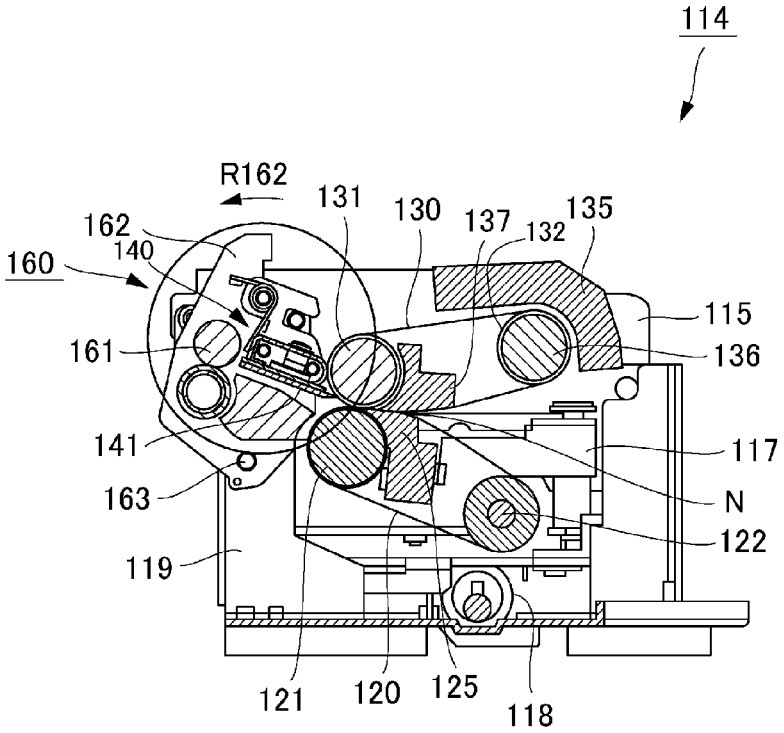
FIG. 2 is an illustration of a structure of a fixing apparatus.
Figure 3:
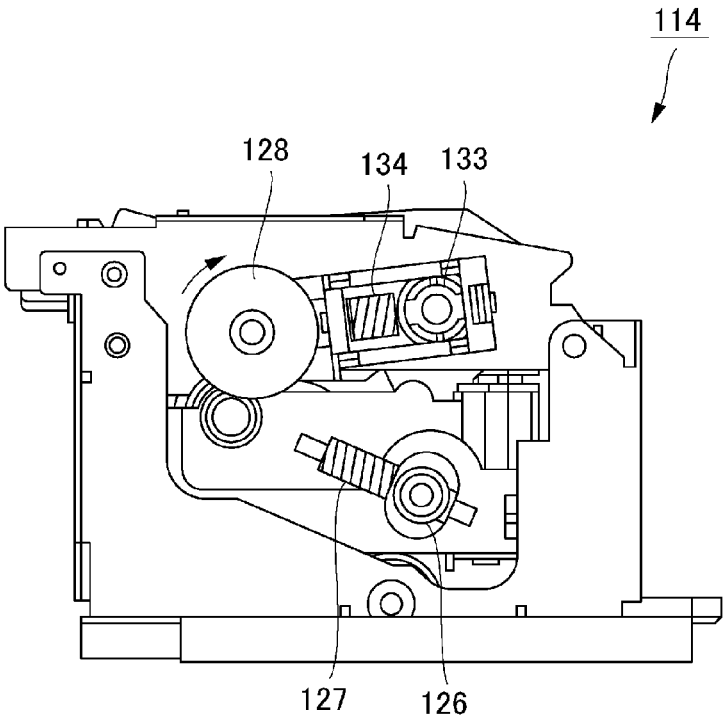
FIG. 3 is an illustration of a structure of a driving system of the fixing apparatus.

FIG. 2 is an illustration of a structure of the fixing apparatus 114 functioning as the image heating apparatus. FIG. 3 is an illustration of a structure of a driving system of the fixing apparatus 114.

The fixing apparatus 114 forms a nip N for the recording material P by causing a pressing belt 120 assembled with a pressing (belt) frame 117 to be press-contacted to a heating belt (rotatable heating member or rotatable fixing member 130 assembled with a fixing (belt) frame 115. The fixing frame 115 is fixed detachably mountable to an apparatus frame 119. The pressing frame 117 is swingable relative to the apparatus frame 119, and this swing operation is performed by driving a contact-and-separation cam 118. As a result, the pressing belt 120 is contacted to and separated from the heating belt 130.

The heating belt 130 is extended around a plurality of rollers, shaft-supported by the fixing frame 115, i.e., a driving roller 131 and a tension roller 132 under the application of predetermined tension (e.g., 200N) and can be rotated and circulated. As the heating belt 130, a belt prepared by coating a 300 μm-thick silicone rubber layer on a magnetic metal layer, such as nickel layer or a stain less steel layer, of 75 μm in thickness, 380 mm in width and 200 mm in circumference, and then by coating the metal layer with a PFA tube as a surface layer may be used. The heating belt 130 is not limited to this belt, but may appropriately be selected from members if the selected member generates heat through electromagnetic induction heating by an exciting coil 135 and has a heat-resistant property.

The heating belt 130 is conveyed by rotation of the driving roller 131. In order to stably convey the recording material P at the nip N, a driving force is transmitted with reliability between the heating belt 130 and the driving roller 131.

The driving roller 131 has a function of supporting an inner surface of the heating belt 130 to generate pressure at the nip N. The driving roller 131 is provided at an exit side of a nip region between the heating belt 130 and the pressing belt 120, and its elastic layer is elastically deformed in a predetermined amount by the press-contact of the pressing roller 121. The driving roller 131 is a roller prepared by forming, through integral molding, an elastic layer of a heat-resistant silicone rubber as a surface layer on a solid metal core formed of stainless steel with an outer diameter of 18 mm.

The tension roller 132 has a function of effecting lateral deviation (shift) control of the heating belt 130 by being raised and lowered at its one end to be inclined and moved and a function of imparting a belt tension to the heating belt 130. The tension roller 132 is a hollow roller formed of stainless steel to have an outer diameter of about 20 mm and an inner diameter of about 18 mm, and functions as a belt stretching roller.

The heating belt 130 is, with its rotation, laterally shifted toward an (one) end of the tension roller 132 with respect to a rotational axis direction and therefore the tension roller 132 is tiled by an unshown steering mechanism to control the lateral movement of the heating belt 130.

Inside the heating belt 130, at a position corresponding to an entrance side (upstream side of the driving roller 131) of the nip region between the heating belt 130 and the pressing belt 120, a pad stay 137 formed of stainless steel (SUS material) is provided. The pad stay 137 is pressed toward a pressing pad 125 under a predetermined pressure of 400 N, thus forming the nip N together with the driving roller 131.

The pressing belt (rotatable pressing member) 120 is extended around pressing roller 121 and a tension roller 122, which are shaft-supported by the pressing frame 117 under application of a predetermined tension (e.g., 200N) and can be rotated and circulated. As the pressing belt 120, a belt prepared by coating, e.g., a 300 μm-thick silicone rubber layer on a nickel layer of 50 μm in thickness, 380 mm in width, and 200 mm in circumference, and then by coating the metal layer with a PFA tube as a surface layer may be used. The pressing belt 120 is not limited to this belt but may appropriately be selected from members if the selected member has a heat-resistant property.

The pressing roller 121 is a solid roller, formed of stainless steel to have an outer diameter of 20 mm, for stretching the pressing belt 121, and is provided at the exit side of the nip region between the pressing belt 120 and the heating belt 130.

The tension roller 122 has a function of effecting lateral deviation (shift) control of the pressing belt 120 by being raised and lowered at its one end to be inclined and moved and a function of imparting a belt tension to the pressing belt 120. The tension roller 122 is a hollow roller formed of stainless steel to have an outer diameter of about 20 mm and an inner diameter of about 18 mm, and functions as a belt stretching roller.

The heating belt 120 is, with its rotation, laterally shifted toward an (one) end of the tension roller 122 with respect to a rotational axis direction, and therefore the tension roller 122 is tilted by an unshown steering mechanism to control the lateral movement of the pressing belt 120.

Inside the pressing belt 120, at a position corresponding to an entrance side (upstream side of the pressing roller 121) of the nip region between the pressing belt 120 and the heating belt 130, the pressing pad 125 formed of silicone rubber is provided. The pressing pad 125 is pressed against the pressing belt 120 under a predetermined pressure of 400 N, thus forming the nip N together with the pressing roller 121.

As shown in FIG. 3, the tension roller 132 is supported by a bearing 133 at each of its end portions, and imparts a tension of 200 N (20 kgf) to the heating belt 130 by a tension spring 134. The tension roller 122 is supported by a bearing 126 at each of its end portions, and imparts a tension of 200 N (20 kgf) to the pressing belt 120 by a tension spring 127.

By an unshown motor, a driving force is externally inputted into a gear 128. The gear 128 is connected to a shaft end of the driving roller 131 (FIG. 2). The driving roller 131 and the pressing roller 121, which are shown in FIG. 2, are connected by an unshown gear train provided at an opposite side to the gear 128, thus being rotated in interrelation with each other.

<Heating Constitution>

The heating belt 130 is heated through electromagnetic induction heating by the exciting coil 135. An unshown temperature controller adjusts electric power supplied to the exciting coil 135 on the basis of temperature information of the heating belt 130 detected by an unshown temperature sensor, so that a surface temperature of the heating belt 130 is temperature-adjusted at 180° C.±2° C.

Further, inside the tension roller 132, a heat pipe 136 for canceling a temperature difference of the tension roller 132 with respect to a longitudinal direction is provided. The heat pipe 136 is formed to have an outer diameter of about 16 mm and a width of about 350 mm and performs a function of maintaining temperature uniformity of the heating belt 130 with respect to the belt widthwise direction. The heat pipe 136 may be appropriately selected from heat-resistant members.

<Separating Plate>

Figure 4:
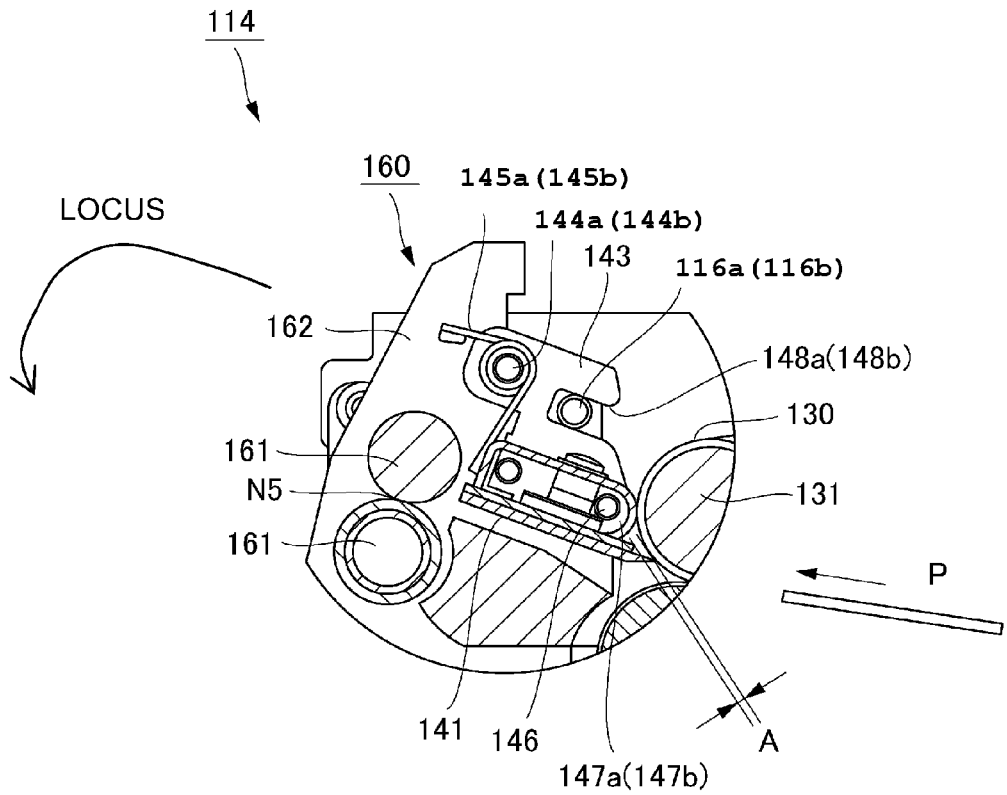
FIGS. 4(*a*) and 4(*b*) are illustrations each showing arrangement of a separating plate in a fixing apparatus in Embodiment 1.
Figure 4:
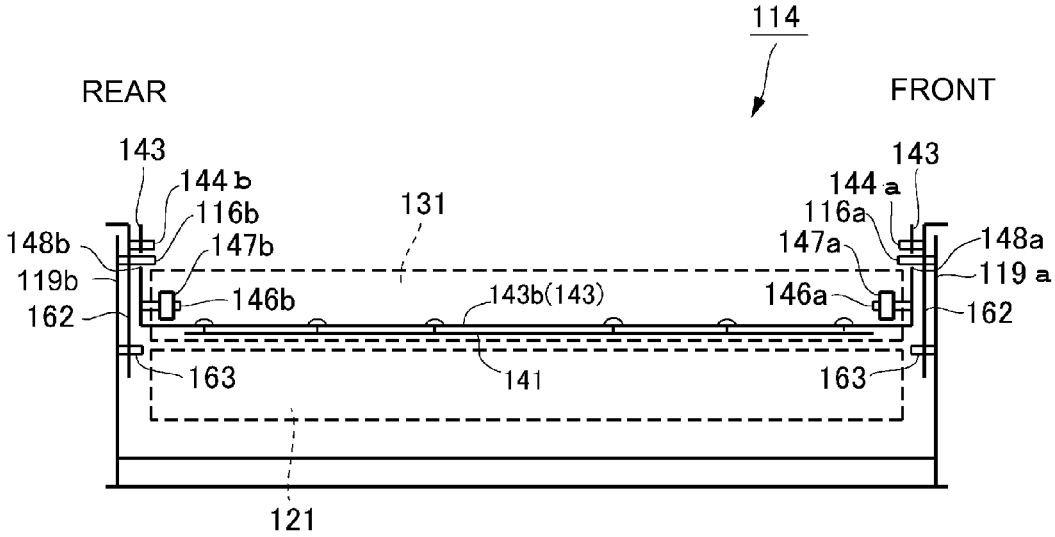

FIGS. 4(*a*) and 4(*b*) illustrate the arrangement of a separating plate 141 in the fixing apparatus 114.

As shown in FIG. 2, the fixing apparatus 114 fixes the toner image on the recording material P by passing the recording material P through the nip N formed by the heating belt 130 and the pressing belt 120. The toner carried on the recording material is melted by heat provided by the heating belt 130. At this time, the melted toner has viscosity and tends to cause the recording material to be deposited on the surface of the heating belt 130. Particularly, in the case where a thin recording material having a low rigidity is subjected to the fixing, there is a possibility that the recording material is wound about the heating belt 130 to generate a jam.

For this reason, the fixing apparatus 114 in this embodiment includes a separating plate (separating member) 141 provided in non-contact with the heating belt 130. The separating plate 141 is disposed near to the heating belt 130 over a whole recording material conveyance region with respect to a widthwise direction of the heating belt 130 (direction perpendicular to a recording material conveyance direction or axial direction of the driving roller 131), and performs a function of separating the recording material from the heating belt 130.

Incidentally, when the separating plate 141 is employed, the recording material is separated from the heating belt 130 in non-contact with the heating belt 130 and therefore it is required that a gap (space) between an edge portion of the separating plate 141 and the heating belt 130 is properly ensured while minimizing the gap to the extent possible.

<Pair of Rollers (Spacers)>

Therefore, in this embodiment, a constitution capable of properly ensuring the gap (space) between the separating plate 141 and the heating belt 130 by using a pair of rollers (spacers) is employed. Specifically, at end portions of a beam member or portion 143*b* for supporting the separating plate 141, a pair of rollers 147*a* and 147*b* is provided and abutted against the heating belt 130. As a result, it becomes possible to properly ensure the gap between the separating plate 141 and the heating belt 130.

<Positioning Constitution of Separating Plate Holder>

In this embodiment, in order to improve the ability of the operator to perform jam clearance, as described later, the separating plate 141 is constituted so that the separating plate 141 can be largely retracted from the heating belt 130. Specifically, the separating plate 141 and the pair of rollers 147*a* and 147*b* are integrally assembled into a unit as a separating plate holder 143, so that the separating plate 141 and the rollers 147*a* and 147*b* can be integrally moved rotationally. As a result, even if a jam occurs in the fixing apparatus 114, it is possible to expose the neighborhood of the exit of the nip N, so that the operator can easily perform jam clearance.

Incidentally, as shown in FIG. 2, in the case where a constitution in which the separating plate holder 143 is rotationally moved in an arrow R162 direction so as to be retracted from the heating belt 130 is employed, during the fixing operation, each of the rollers 147*a* and 147*b* is required to be properly abutted against an outer peripheral surface of the heating belt 130 in an associated one of widthwise end sides of the heating belt 130, but in this embodiment, an improvement is made by paying attention to this point.

In this embodiment, a mechanism (fixing and sheet discharging unit 160 described later) for pressing the separating plate holder 143 toward the heating belt 130 is provided. Further, a constitution in which a position of the separating plate holder 143 relative to the heating belt 130 is determined by three positions (portions) in total including two positions where the rollers 147*a* and 147*b* are abutted against the heating belt 130, respectively, and a position where only a fixing frame shaft 116*b* of a pair of fixing frame shafts 116*a* and 116*b* is abutted against a stopper 148' located at an end point of a guiding slot 148*a* (FIG. 6) is employed.

For that reason, in this embodiment, the separating plate holder 143 is constituted so that a separating plate rotation shaft (rotational movement center) 144 is held by the fixing and sheet discharging unit 160 with considerable play (so-called unloaded hole). Therefore, with abutment of the rollers 147*a* and 147*b* against the heating belt 130, the support (separating plate holder) 143 is inclined.

Incidentally, in the case of a constitution in which such play is not provided, the separating plate holder 143 is positioned relative to the heating belt 130 at four positions (portions) in total, but there is a possibility that the separating plate holder 143 is separated from the heating belt 130 at one of the four positions, e.g., that one of the rollers 147*a* and 147*b* is separated from the heating belt 130. On the other hand, in this embodiment, by employing the above-described constitution in the present invention, it is possible to prevent the occurrence of the problem that one of the rollers 147*a* and 147*b* is separated from the heating belt 130.

Incidentally, the separating plate 141 is fixedly supported by the separating plate holder 143, which extends along the separating plate 141 and which has rigidity higher than the separating plate 141. The separating plate 141 is fixed to the separating plate holder 143 at a plurality of fixing positions provided at intervals with respect to its extending direction.

Figure 5:
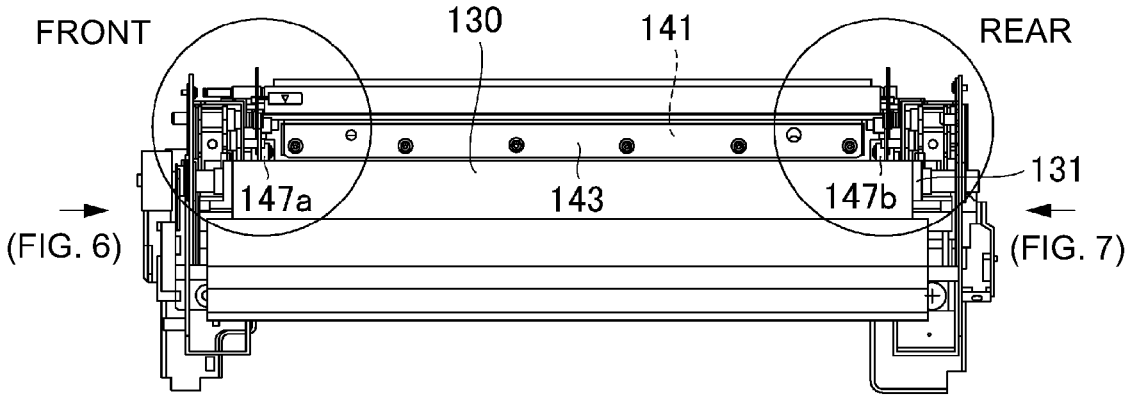
FIGS. 5(*a*) and 5(*b*) are illustrations each showing arrangement of the separating plate and a roller in Embodiment 1.
Figure 5:
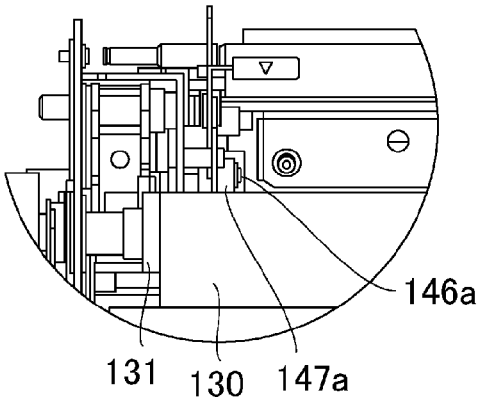
Figure 5:
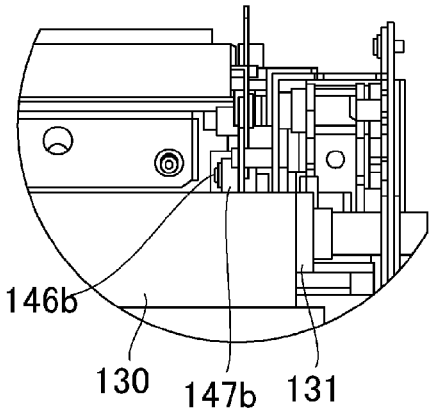
Figure 6:
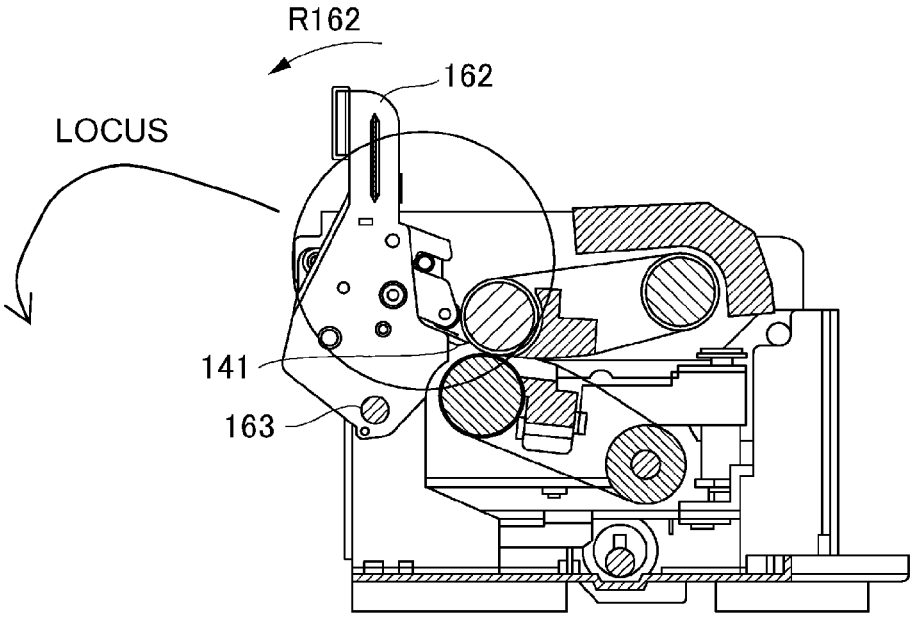
FIGS. 6(*a*) and 6(*b*) are illustrations of a guiding slot in a front side.
Figure 6:
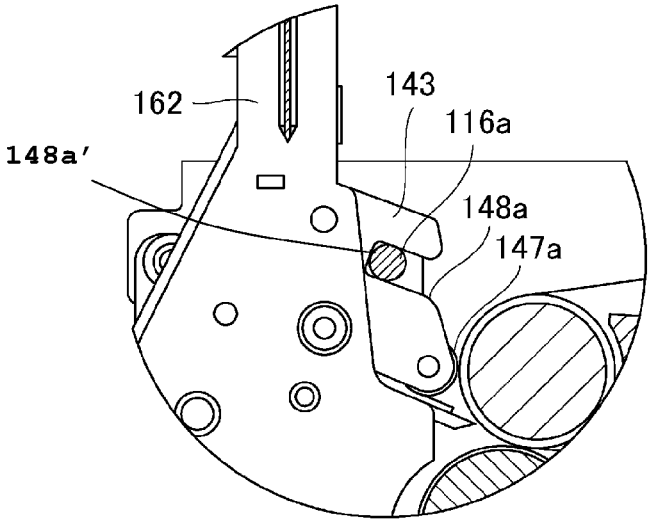
Figure 7:
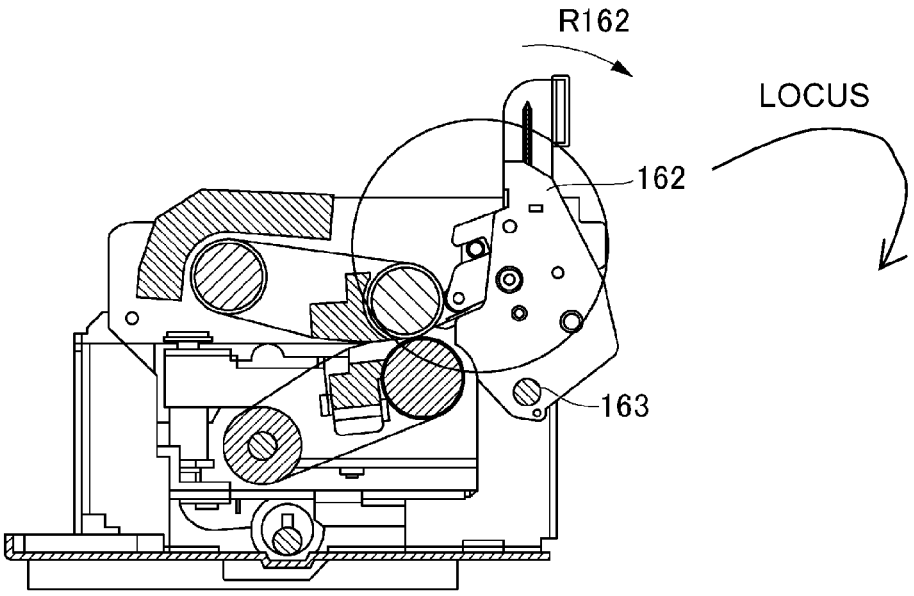
FIGS. 7(*a*) and 7(*b*) are illustrations of the guiding slot in a rear side.
Figure 7:
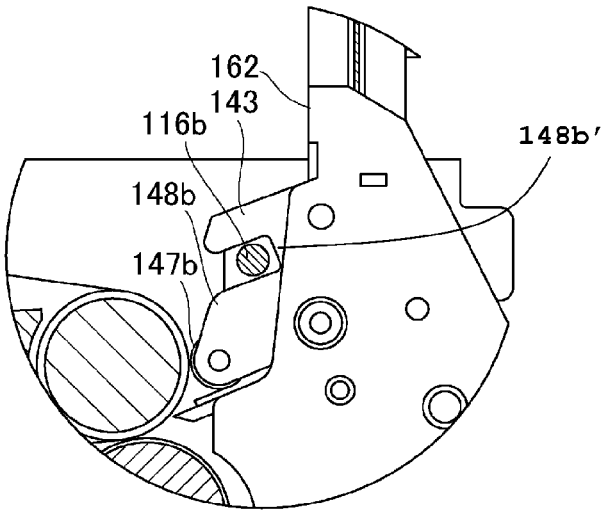
Figure 8:
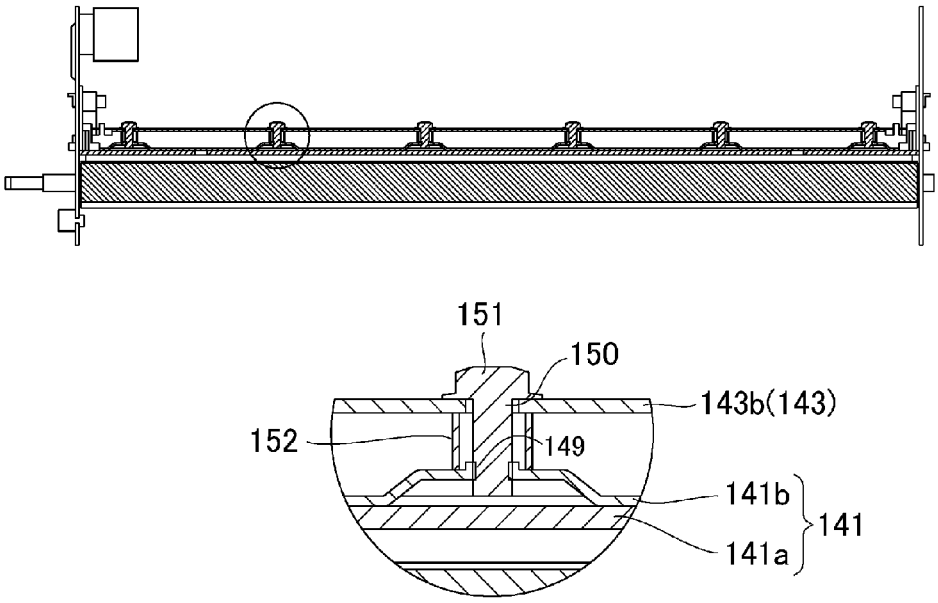
FIG. 8 is an illustration of a separating plate mounting structure.

FIGS. 5(*a*)-5(*c*) are illustrations each showing arrangement of the separating plate and the rollers in Embodiment 1. FIGS. 6(*a*) and 6(*b*) are illustrations of the guiding slot at a front side. FIGS. 7(*a*) and 7(*b*) are illustrations of the guiding slot at a rear side. FIG. 8 is an illustration of a separating plate mounting structure.

As shown in FIG. 2, the fixing and sheet discharging unit 160 functioning as a holding unit is shaft-supported by the apparatus frame 119 for rotatably supporting the heating belt 130 via a plurality of rollers, so that the separating plate holder 143 (separating plate 141) is rotationally movable in a direction in which the separating plate holder 143 is retracted from the heating belt 130. The fixing and sheet discharging unit 160 includes a fixing and sheet discharging unit frame 162, and the fixing and sheet discharging unit frame 162 shaft-supports a fixing and sheet discharging roller pair 161, which is a rotatable member pair for nipping and conveying the recording material separated from the heating belt 130.

The fixing and sheet discharging unit 160 has a structure in which the fixing and sheet discharging roller pair 161 and the separating plate holder 143 are assembled with the fixing and sheet discharging unit frame 162. The fixing and sheet discharging unit 160 is, in order to facilitate jam clearance, rotationally moved about the rotation shaft 163 in the arrow R162 direction, thus being openable and closable with respect to the fixing frame 115. The fixing and sheet discharging roller pair 161 conveys the recording material P, on which the image is fixed at the nip N, immediately after the recording material P passes through the nip N. The separating plate 141 is an auxiliary means for separating the recording material from the heating belt 130.

As shown in FIG. 4(*a*), the heating belt 130 is rotatably supported by the fixing frame 115 via a plurality of rollers, thus heating an image surface of the recording material. The separating plate 141 opposes the heating belt 130 at its edge (end) portion, and the separating plate 141 separates the recording material from the heating belt 130. The separating plate 141 is a guiding member for guiding the recording material to a nip N5 of the downstream fixing and sheet discharging roller pair 161 at its downstream end, while disposing its upstream end (the above-described edge portion) near to the heating belt 130 with respect to the recording material conveyance direction.

The rollers 147*a* and 147*b*, which are a pair of spacer members, contact an outer peripheral surface of the heating belt 130. The separating plate holder 143 brings the rollers 147*a* and 147*b*, which are rotatable members capable of being rotated by the heating belt 130, into contact with the peripheral surface of the heating belt 130 at positions, respectively, outside a contactable range of the heating belt 130 with the recording material. The separating plate holder 143, functioning as the separating unit, integrally includes the rollers 147*a* and 147*b* and the separating plate 141 for which a positional relationship is fixed. The fixing and sheet discharging unit 160, functioning as the holding unit, rotatably and movably holds the separating plate holder 143. A spring as an urging member is provided between the fixing and sheet discharging unit 160 and the separating plate holder 143 to urge the separating plate holder 143 toward the heating belt 130. This spring 143 is provided similarly also in the rear side shown in FIG. 7(*b*).

As shown in FIG. 4(*b*), the pair of rotation shafts 163 is fixed at its base portion on the apparatus frame 119 of the fixing apparatus 114 and is protruded toward the inside of the fixing apparatus 114. The fixing and sheet discharging unit 160 can be rotated about the rotation shafts 163 so that the separating plate 141 can open in a direction in which the separating plate 141 is retracted from the driving roller 131.

The fixing frame shafts 116*a* and 116*b*, functioning as a pair of shaft portions, are fixed on the apparatus frames 119*a* and 119*b*, respectively, and are disposed between the separating plate holder 143 and the apparatus frame 119*a* or 119*b*. The fixing frame shafts 116*a* and 116*b* are constituted so as to be inserted and guided into guide slits 148*a* and 148*b* described later.

The guide slits 148*a* and 148*b*, functioning as a pair of guiding slots, guide the separating plate holder 143 with the rotational movement of the fixing and sheet discharging unit 160. These guide slits 148*a* and 148*b* are provided on the separating plate holder 143.

In a state in which the fixing and sheet discharging unit 160 is rotationally moved and thus the rollers 147*a* and 147*b* are contacted to the heating belt 130, one of the fixing frame shafts 116*a* and 116*b* is held at the stopper portion (148*a*' or 148*b*') located at the end point of a corresponding one of the guide slits 148*a* and 148*b*. On the other hand, another one of the fixing frame shafts 116*a* and 116*b* is held at an intermediary position where the shaft does not reach the stopper portion (148*a*' or 148*b*') located at the end point of the corresponding one of the guide slits 148*a* and 148*b*. Further, as indicated as a locus in FIG. 6(*b*), the guide slits 148*a* and 148*b* are configured to guide the separating plate holder 143 so that the whole separating plate 141 does not contact the heating belt 130 in a process in which the fixing and sheet discharging unit 160 is rotationally moved so that the edge portion of the separating plate 141 is spaced from the heating belt 130.

Each of the pair of separating plate rotation shafts 144*a* and 144*b* is fixed on the fixing and sheet discharging unit frame 162 at its base portion and is protruded toward the inside of the fixing apparatus 114. The separating plate holder 143 is rotationally movable, in a play-permitted state, about the pair of separating plate rotation shafts 144*a* and 144*b* at end sides thereof with respect to the belt widthwise direction of the heating belt 130. The separating plate rotation shafts 144*a* and 144*b* are held in shaft holes of the separating plate holder 143 with play, and therefore the separating plate holder 143 is movable relative to the fixing and sheet discharging unit frame 162 within the range of play. The separating plate 141 is, as described later, supported so that the separating plate 141 is positionally adjustable relative to the separating plate holder 143 with respect to a height direction at a plurality of longitudinal positions.

As shown in FIG. 4(*a*), the pair of springs 145*a*, 145*b* is provided at the front side and the rear side and presses the separating plate holder 143 in a direction in which the end of the separating plate 141 approaches the heating belt 130. Further, concurrently, the springs 145*a*, 145*b* support the separating plate holder 143 so as to raise the separating plate holder 143, thus enabling movement of the separating plate holder 143 relative to the fixing and sheet discharging unit frame 162 in the vertical (up-down) direction within the range of play around the separating plate rotation shafts 144*a* and 144*b*.

As shown in FIG. 5(*a*), at ends of the separating plate holder 143 at the front and rear sides, the rollers 147*a* and 147*b* are independently disposed by being abutted against the heating belt 130 at end portions of the heating belt 130. As shown in FIG. 5(*b*), the roller 147*a* rotatably supported by the shaft 146*a* is the front-side roller, and as shown in FIG. 5(*c*), the roller 147*b* rotatably supported by the shaft 146*b* is the rear-side roller.

As shown in FIG. 4(*a*), the rollers 147*a* and 147*b* are formed of PFA resin material and are contacted and pressed to the heating belt 130 by a spring force (e.g., 0.03N) of the springs 145*a*, 145*b*. The front-side roller 147*a* and the rear-side roller 147*b* are contacted and pressed to the heating belt 130, and therefore it would be considered that abrasion (wearing) or the like due to friction occurs, but in Embodiment 1, there is no possibility of the occurrence of the abrasion of the heating belt 130 on the basis of the materials for the rollers and the belt and the relationship in contact pressure between these members. Incidentally, the material for the rollers 147*a* and 147*b* may also be appropriately selected from materials other than the PFA resin material if the selected material has anti-wearing property.

As shown in FIG. 6(*a*), the separating plate holder 143 is supported movably relative to the fixing and sheet discharging unit frame 162 in the height direction and movably in the direction in which the separating plate holder 143 protrudes toward the driving roller 131. For this reason, in a process in which the fixing and sheet discharging unit 160 is opened and closed (rotated) about the rotation shaft 163, there is a possibility that the separating plate 141 is contacted to the heating belt 130 to damage (scar) the heating belt 130.

For this reason, as shown in FIG. 6(*b*), a front-side vertical plate of the separating plate holder 143 is provided with a front-side guide slit 148*a* to be guided by the fixing frame shaft 116*a*. As shown in FIG. 7(*b*), a rear-side vertical plate of the separating plate holder 143 is provided with a rear-side guide slit 148*b* to be guided by the fixing frame shaft 116*b*. For this reason, during the opening and closing of the fixing and sheet discharging unit 160, the separating plate holder 143 is pressed down in its heating belt 130 side at both of the front and rear sides, so that the end of the separating plate 141 by-passes the heating belt 130.

The front-side guide slit 148*a* and the rear-side guide slit 148*b* cause the separating plate holder 143 to be guided by the fixing frame shafts 116*a* and 116*b* during a closing operation of the fixing and sheet discharging unit 160 toward the fixing frame 115. The separating plate holder 143 is lowered at its heating belt 130 side within a range of play of mounting thereof on the fixing and sheet discharging unit frame 162, thus causing the separating plate 141 to take a locus for by-passing the belt 130.

Further, as described above, in order to position the separating plate 141 relative to the heating belt 130 (driving roller 131), the separating plate holder 143 may preferably be constrained at one position in addition to the positions of the rollers 147*a* and 147*b*. This is because when the separating plate holder 143 is constrained at two or more positions in addition to the positions of the rollers 147*a* and 147*b*, one of the rollers 147*a* and 147*b* is raised from the heating belt 130, and thus the separating plate 141 fails to perform the function of the spacer. Therefore, in this embodiment, as shown in FIG. 6(*b*), in a closed state of the fixing and sheet discharging unit 160, the front-side guide slit 148*a* is abutted against the fixing frame shaft 116*a*. At this time, as shown in FIG. 7(*b*), the fixing frame shaft 116*b* is held by the rear-side guide slit 148*b* with play.

In this embodiment the positioning of the separating plate 141 relative to the heating belt 130 is performed at three positions in total, consisting of the two positions where the spacer members are contacted to the heating belt 130 and another one position. Specifically, the separating unit 140 is positioned at two points where the front-side roller 147*a* and the rear-side roller 147*b* are contacted and pressed to the heating belt 130 and a point of an abutment portion where the front-side guide slit 148*a* is abutted against the fixing frame shaft 116*a*. For this reason, the edge portion of the separating plate 141 can follow a positional change, due to a thickness of the heating belt 130 and thermal expansion of the heating belt 130 including the driving roller 131, over a whole region with respect to the longitudinal direction of the surface of the heating belt 130, so that a distance A can be kept constant.

Incidentally, opposite to this embodiment, a constitution in which the fixing frame shaft 116*a* is held by the front-side guide slit 148*a* with play so as not to be abutted against the stopper portion 148*a*', and the fixing frame shaft 116*b* is abutted against and constrained by the stopper 146*b*' of the rear-side guide slit 148*b* may also be employed.

As shown in FIG. 4(*b*), the beam portion (supporting member) 143*b* of the separating plate holder 143 is mounted at a plurality of positions along the longitudinal direction of the edge portion of the separating plate 141 so that an interval (spacing) between the heating belt 130 and the separating plate 141 is independently adjustable at each of the positions.

As shown in FIG. 8, the separating plate 141 is supported by the separating plate holder 143 so as to hang from the separating plate holder 143. The separating plate 141 is prepared by spot-welding a 0.2 mm-thick stainless steel blade 141*a* on a 1.0 mm-thick supporting-plate 141*b* at a pitch of 20 mm. The supporting plate 141*b* is provided with tapped (screwed) holes for mounting at 6 positions at a pitch of 60 mm.

The separating plate holder 143 fixes and supports the separating plate 141 at 6 fixing positions provided at the pitch of 60 mm with respect to the longitudinal direction. At each of the fixing positions, the separating plate 141 is provided with the tapped hole 149 and the separating plate holder 143 is provided with a through hole 150. Around the outside of an adjusting screw 151 engaged with the tapped hole 149, an adjusting spring 152 for urging the separating plate 141 is disposed. The adjusting spring 152 urges, as shown in FIGS. 4(*a*) and 4(*b*), the separating plate 141 in the direction of the distance A between the end of the separating plate 141 and the surface of the heating belt 130. By adjusting the adjusting springs 152 at the 6 positions, the distance A between the end of the separating plate 141 and the surface of the heating belt 130 is adjustable.

By moving a digital camera for measurement along a gap while shooting a motion picture with a magnification of 100 from a direction perpendicular to the distance A, the a distance distribution in the gap is measured over a whole opposing gap region between the separating plate 141 and the heating belt 130. Further, in accordance with the measurement distance distribution, a screw-in amount of the adjusting screw 151 is individually adjusted, so that the opposing distance in the gap between the separating plate 141 and the heating belt 130 is adjusted within 0.5 mm±0.05 mm over the whole region with respect to the longitudinal direction. Warping of the separating plate 141 is rectified or is intentionally set so as to follow a curved surface of the heating belt 130.

As a result, it is possible to accurately ensure the distance between the edge portion of the separating plate 141 and the heating belt 130 over the whole longitudinal region. By improving the accuracy of the end position of the separating plate 141, the recording material passing through the nip N is prevented from being wound about the heating belt 130 and jamming of the recording material is prevented with a high probability, and therefore high productivity and high quality, which are required for the image forming apparatus, can be achieved.

As described above, the fixing apparatus in this embodiment has a structure in which the spacer member for ensuring the distance between the edge portion of the separating plate 141 and the heating belt 130 over the whole longitudinal region is independently provided at each of the front side and the rear side, and has a structure in which the warping of the separating plate 141 is adjustable with respect to the rectifying direction.

Incidentally, in this embodiment, the fixing apparatus of the belt-heating type is described in detail, but the rotatable heating member (rotatable fixing member) is not limited to the belt, but may also be a roller. Further, also the rotatable pressing member is not limited to the belt, but may also be a roller.

Further, in this embodiment, the mounting structure of the separating plate 141 for separating the recording material from the heating belt 130 of the fixing apparatus 114 is described, but the structure is not limited to the above-described structure but may also be similarly applicable to the pressing belt 120 as the rotatable pressing member. Further, the structure is similarly applicable to also a rotatable conveying member, for conveying the recording material in the image forming apparatus, such as an intermediary transfer belt or a recording material conveying belt (transfer belt) which has a function of conveying the recording material.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 103009/2012 filed Apr. 27, 2012, which is hereby incorporated by reference.

What is claimed is:

1. An image heating apparatus comprising:

a rotatable member configured to form a nip for heating a toner image on a sheet;

a pair of frames configured to rotatably support said rotatable member at widthwise ends of said rotatable member;

a separating unit including a separating plate configured to separate the sheet from said rotatable member and a pair of spacers configured to form a space between said separating plate and said rotatable member by being abutted against said rotatable member at the widthwise ends, respectively; and a holding unit including a holding portion configured to rotatably hold said separating unit and an urging portion configured to urge said separating unit toward said rotatable member, wherein said holding unit is rotatable about a rotation center between a first position where said pair of spacers is abutted against said rotatable member and a second position where said pair of spacers is spaced from said rotatable member, wherein said pair of frames includes a pair of shaft portions, and said separating unit includes a pair of guiding slots configured to guide said pair of shaft portions, respectively, with movement of said holding unit from the second position to the first position, and wherein said holding portion permits inclination of said separating unit so that only one of said pair of shaft portions is abutted against a stopper portion of its associated guiding slot with the abutment of said pair of spacers against said rotatable member.

2. An apparatus according to claim 1, wherein said holding portion is provided in each of widthwise end sides of said rotatable member, and said separating unit includes a pair of holes each held by said holding portion with predetermined play.

3. An apparatus according to claim 1, wherein said separating unit includes a plurality of mounting portions, where said separating plate is mounted so that the space is within a predetermined range, at different positions with respect to a widthwise direction of said rotatable member.

4. An apparatus according to claim 1, wherein each of said pair of spacers is abutted against said rotatable member outside a region where said spacer is contactable to the sheet, with respect to a widthwise direction of said rotatable member.

5. An apparatus according to claim 1, wherein each of said pair of spacers includes a rotatable member rotated by said rotatable member configured to form the nip.

6. An apparatus according to claim 1, wherein at the second position, a portion of said apparatus downstream of an exit of the nip is exposed to facilitate jam clearance of the sheet.

7. An apparatus according to claim 6, wherein said holding unit includes a pair of rotatable members configured to nip and convey the sheet passed through the nip.

8. An apparatus according to claim 1, wherein said rotatable member includes an endless belt contactable to said pair of spacers and a plurality of rollers configured to rotatably support an inner surface of said endless belt, and said pair of frames supports said rotatable member via the plurality of rollers.

9. An apparatus according to claim 1, wherein said rotatable member is provided so as to be contactable to the toner image on the sheet.

10. A fixing apparatus comprising:

a rotatable fixing member configured to fix a toner image on a sheet at a nip;

a pair of frames configured to rotatably support said rotatable fixing member at widthwise ends of said rotatable fixing member;

a separating unit including a separating plate configured to separate the sheet from said rotatable fixing member and a pair of spacers configured to form a space between said separating plate and said rotatable fixing member by being abutted against said rotatable fixing member at the widthwise ends, respectively; and a holding unit including a holding portion configured to rotatably hold said separating unit and an urging portion configured to urge said separating unit toward said rotatable fixing member, wherein said holding unit is rotatable about a rotation center between a first position where said pair of spacers is abutted against said rotatable fixing member and a second position where said pair of spacers is spaced from said rotatable fixing member, wherein said pair of frames includes a pair of shaft portions provided in widthwise end sides of said rotatable fixing member, and said separating unit includes a pair of guiding slots configured to guide said pair of shaft portions, respectively, with movement of said holding unit from the second position to the first position, and wherein said holding portion permits inclination of said separating unit so that only one of said pair of shaft portions is abutted against a stopper portion of its associated guiding slot with the abutment of said pair of spacers against said rotatable fixing member.

11. An apparatus according to claim 10, wherein said holding portion is provided in each of the widthwise end sides of said rotatable fixing member, and said separating unit includes a pair of holes each held by said holding portion with predetermined play.

12. An apparatus according to claim 10, wherein said separating unit includes a plurality of mounting portions, where said separating plate is mounted so that the space is within a predetermined range, at different positions with respect to a widthwise direction of said rotatable fixing member.

13. An apparatus according to claim 10, wherein each of said pair of spacers is abutted against said rotatable fixing member outside a region where spacer is contactable to the sheet, with respect to a widthwise direction of said rotatable fixing member.

14. An apparatus according to claim 10, wherein each of said pair of spacers includes a rotatable member rotated by said rotatable fixing member.

15. An apparatus according to claim 10, wherein at the second position, a portion of said apparatus downstream of an exit of the nip is exposed to facilitate jam clearance of the sheet.

16. An apparatus according to claim 15, wherein said holding unit includes a pair of rotatable fixing members configured to nip and convey the sheet passed through the nip.

17. An apparatus according to claim 10, wherein said rotatable fixing member includes an endless belt contactable to said pair of spacers and a plurality of rollers configured to rotatably support an inner surface of said endless belt, and said pair of frames supports said rotatable fixing member via the plurality of rollers.

18. An image forming apparatus comprising:

a rotatable conveying member configured to convey a sheet at a nip;

a pair of frames configured to support said rotatable conveying member;

a separating unit including a separating plate configured to separate the sheet from said rotatable conveying member and a pair of spacers configured to form a space between said separating plate and said rotatable conveying member by being abutted against said rotatable conveying member at the widthwise ends, respectively; and a holding unit including a holding portion configured to rotatably hold said separating unit and an urging portion configured to urge said separating unit toward said rotatable conveying member, wherein said holding unit is rotatable about a rotation center between a first position where said pair of spacers is abutted against said rotatable conveying member and a second position where said pair of spacers is spaced from said rotatable conveying member, wherein said pair of frames includes a pair of shaft portions provided in widthwise end sides of said rotatable conveying member, and said separating unit includes a pair of guiding slots configured to guide said pair of shaft portions, respectively, with movement of said holding unit from the second position to the first position, and wherein said holding portion permits inclination of said separating unit so that only one of said pair of shaft portions is abutted against a stopper portion of its associated guiding slot with the abutment of said pair of spacers against said rotatable conveying member.

19. An apparatus according to claim 18, wherein said holding portion is provided in each of widthwise end sides of said rotatable conveying member, and said separating unit includes a pair of holes each held by said holding portion with predetermined play.

* * * * *